US008141256B1

(12) United States Patent
Siblik

(10) Patent No.: US 8,141,256 B1
(45) Date of Patent: Mar. 27, 2012

(54) CEILING TILE RELIEF CUTTER

(76) Inventor: Allen D. Siblik, Spring Grove, IL (US)

( * ) Notice: Subject to any disclaimer, the term of this patent is extended or adjusted under 35 U.S.C. 154(b) by 725 days.

(21) Appl. No.: 12/037,592

(22) Filed: Feb. 26, 2008

Related U.S. Application Data

(60) Provisional application No. 60/903,568, filed on Feb. 27, 2007.

(51) Int. Cl.
*B26B 1/08* (2006.01)
*B26B 29/06* (2006.01)

(52) U.S. Cl. ..... 30/287; 30/2; 30/294; 30/314; 30/320

(58) Field of Classification Search ..... 30/2, 279.2, 30/287–289, 293, 294, 314, 317, 280, 286, 30/290, 291, 282, 315, 320, 321
See application file for complete search history.

(56) References Cited

U.S. PATENT DOCUMENTS 1,908,851 A * 5/1933 Lefever et al. ..... 30/2
2,065,761 A * 12/1936 Smith ..... 30/293
3,068,569 A * 12/1962 Campbell, Jr. ..... 30/294
3,183,598 A 5/1965 Parr
3,772,785 A * 11/1973 Fischer ..... 30/293
4,467,524 A * 8/1984 Ruff et al. ..... 30/2
4,493,148 A * 1/1985 Ruff ..... 30/2
4,620,368 A * 11/1986 Bowman ..... 30/294
4,667,409 A * 5/1987 D'Amato ..... 30/289
4,735,531 A 4/1988 Boerckel et al.
4,777,724 A * 10/1988 Sirchia ..... 30/287
4,895,483 A 1/1990 Anderson
5,048,188 A * 9/1991 Wolff ..... 30/288
5,758,423 A * 6/1998 Eversole et al. ..... 30/279.2
5,996,237 A 12/1999 Sanders
6,612,036 B2 * 9/2003 Frazier ..... 30/293

OTHER PUBLICATIONS

Purfling cutter—p. 33—Steel String Guitar Construction, Irving Sloane, 1975.

* cited by examiner

*Primary Examiner* — Clark F. Dexter
(74) *Attorney, Agent, or Firm* — Patnaude & Videbeck

(57) ABSTRACT

A manually operable ceiling tile cutting tool has a blade slidably retained in one of several pockets or slots in the tool. Each of the pockets formed by complementary grooves and ridges defines a flat blade receiving surface, is a differing predetermined distance from a bottom of the tool which corresponds to a standard dimension in a ceiling tile relief for a suspended ceiling.

4 Claims, 4 Drawing Sheets

CEILING TILE RELIEF CUTTER

This application claims the priority of provisional application No. 60/903,568, filed Feb. 27, 2007, the contents of which are incorporated herein by reference.

This invention relates to hand tools and, more particularly, to an adjustable ceiling tile relief cutter that utilizes a slidable blade in a housing capable of positioning the blade at a plurality of predetermined distances from a flat surface.

BACKGROUND OF THE INVENTION

Ceiling tiles for use on suspended ceilings utilized in offices, schools, public and residential buildings and the like, sit on a horizontally oriented framework below a ceiling. Often it is desirable to provide a relief around the edge of ceiling tiles to allow the edge of the tile to nest on the framework with the exposed bottom face of the tile extending below the framework. Hand tools adaptable for cutting such relief in ceiling tiles have been disclosed. However, the adjustable tools have been analog in nature, i.e., adjustable by sliding the blade along a restraint, often having a scale thereon, and affixing that blade anywhere along the restraint. However, in most instances, architectural designs of ceiling tiles have a few set dimensions for such tile reliefs.

A need has arisen for a manually usable hand tool capable of cutting ceiling tile reliefs at an easily adjustable multiple of standardized dimensions.

It is therefore an object of the present invention, generally stated to provide an improved manually operable ceiling tile relief cutter.

Another object of the invention is the provision of an adjustable manually operated ceiling tile relief cutter having a plurality of discrete and distinct operating positions to provide a plurality of differing standardized relief cuts.

SUMMARY OF THE INVENTION

The invention resides in a tool for manually cutting relief surfaces adjacent ceiling tile edges. The tool comprises: a body assembly including top and bottom members. One of the top and bottom members includes a first groove forming an indent in said one member, having a substantially flat nadir (i.e., bottom surface), and extending across a surface thereof forming an inner surface of the tool. The other of the top and bottom members includes a first rib, forming a detent in the other member, having a substantially flat apex and extending across a surface thereof forming an inner surface of the tool. A blade (also referred to as a knife) is sized to slidably fit on the groove nadir, on one side thereof, and be retained thereon by the apex of the complementary rib on an opposing side thereof. Fastener means hold the top and bottom members together and slidably retain the blade thereon, and a first distance from the blade to a working outer surface of the tool is at least one dimension corresponding to a relief on a ceiling tile.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENTS

Figure 1:
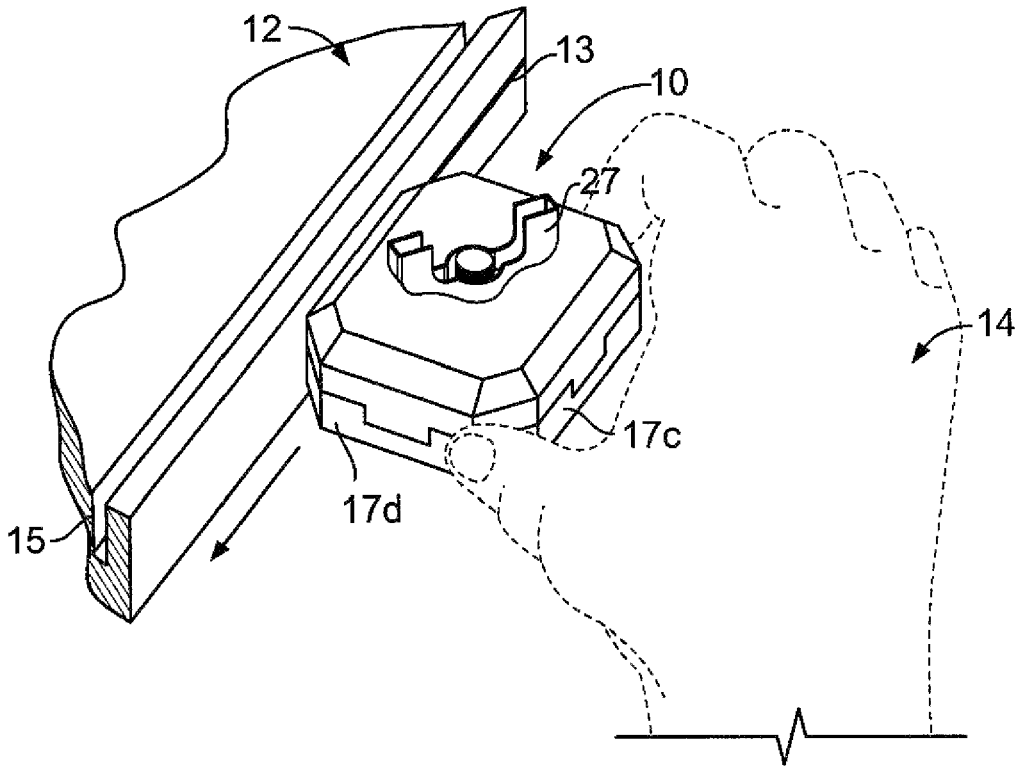
FIG. 1 is a fragmentary perspective view of a ceiling tile, constructed in accordance with a first embodiment of the present invention with the manually operated ceiling tile relief cutter shown positioned on a flat surface and cutting a relief surface.
Figure 2:
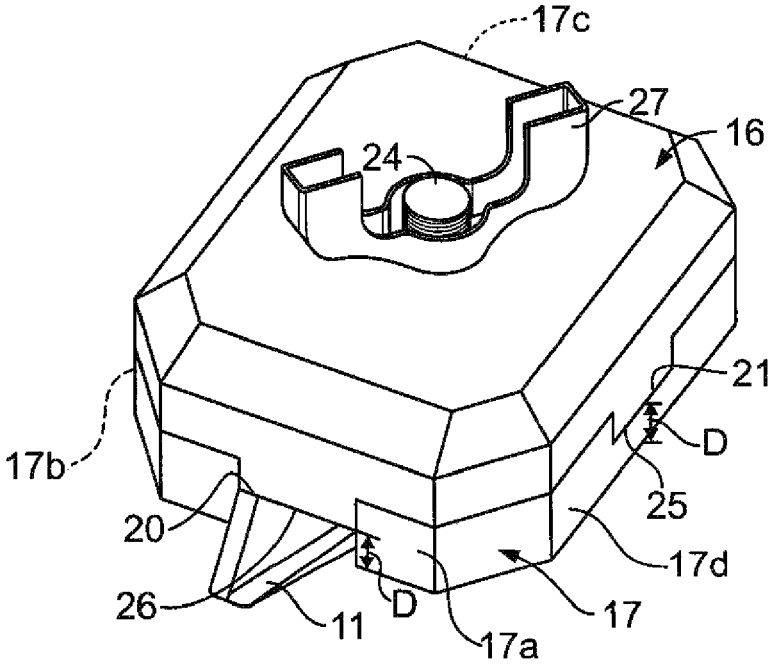
FIG. 2 is a top quarter perspective view of the ceiling tile relief cutter shown in FIG. 1 constructed for two differing relief cutting dimensions.
Figure 3:
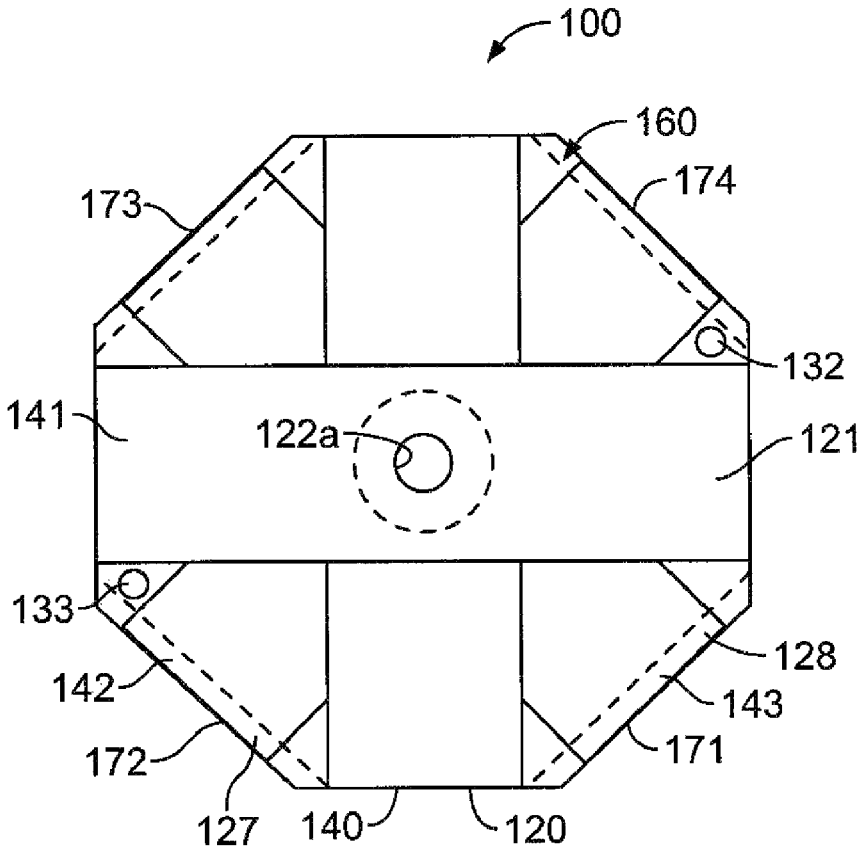
FIG. 3 is a bottom plan view of a top member of a second embodiment of the ceiling tile relief cutter of the present invention showing four differing slots thereon.
Figure 4:
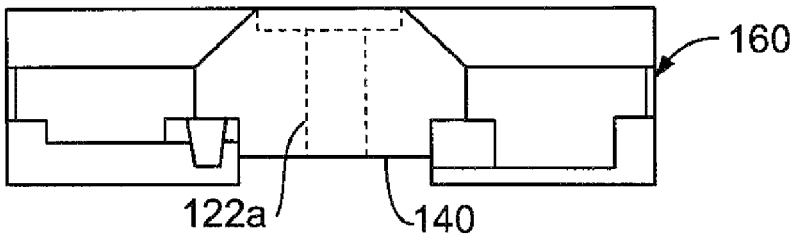
FIG. 4 is a front elevational view of the second embodiment top member shown in FIG. 3.
Figure 5:
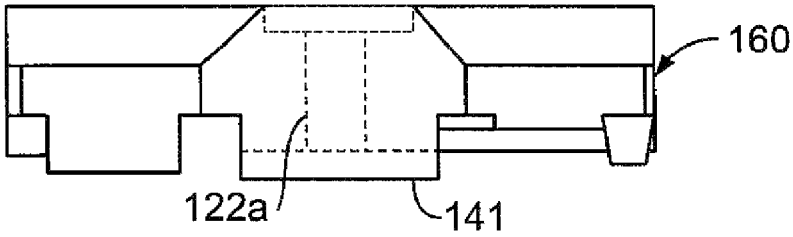
FIG. 5 is an end elevational view of the second embodiment top member shown in FIG. 3.
Figure 6:
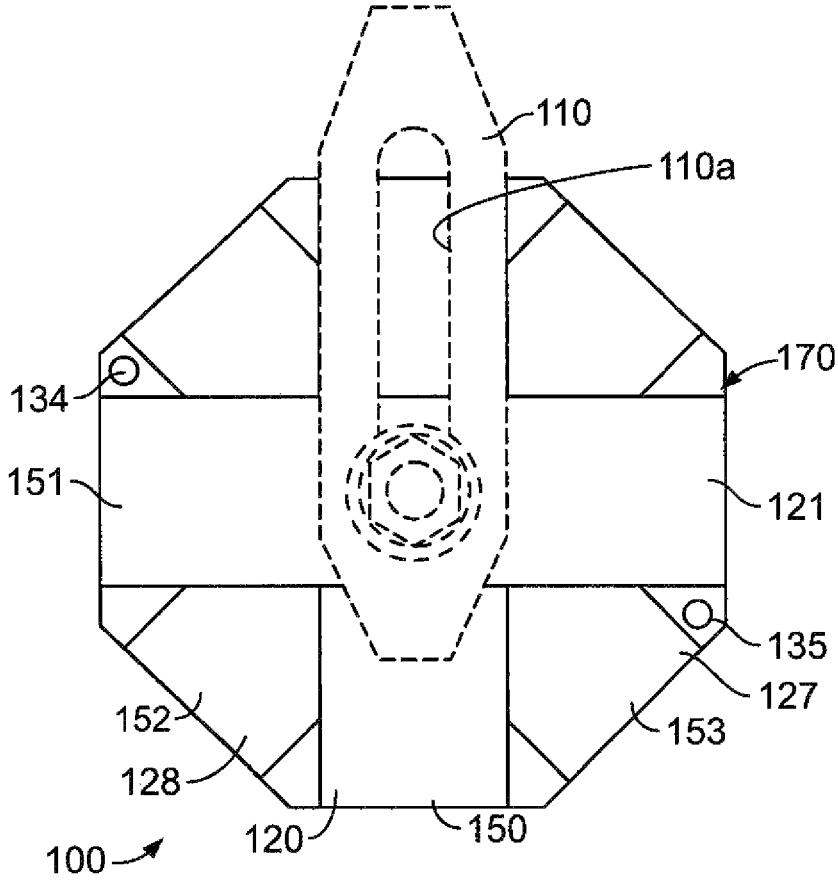
FIG. 6 is a top plan view of the bottom member of the second embodiment of the present invention showing a slidable razor, specifically a double-edged knife blade, positioned in one of the slots.

Referring to FIGS. 1 and 2, FIG. 1 shows a first embodiment of the multiple position adjustable relief cutting tool, generally indicated at 10, constructed in accordance with the present invention with a blade 11 (not shown) (FIG. 2) sticking into the side of a ceiling tile shown generally at 12, cutting a second horizontal relief surface 13 on the tile by the manual manipulation of the user generally at 14. Both the ceiling tile and the adjustable tool are lying on a flat surface. A first cut 15 has already been made with the ceiling tile standing on its end.

FIG. 2 is a perspective view of the ceiling tile relief cutter 10 shown in FIG. 1. It has been rotated 90 degrees so one can see the commercially obtainable double edged knife blade 11 sticking out of the holder. As noted in FIG. 2, the distance (D) of the blade from the bottom of the tool as shown differs from the distance (d) of the blade from the bottom of the tool if the blade was positioned at 90 degrees in the tool to where it is presently. This difference gives the first embodiment of the present invention two differing cutter heights, 0.375 inch (D) and 0.450 inch (d), for creating reliefs of differing sizes, or a relief having one side of one dimension and another relief cut 90 degrees to that side of the second dimension. The bottom member 17 of the generally rectangular tool includes on its top surface two rectangularly cross sectional shaped grooves or slots 20 and 21, respectively, positioned at 90 degree angles thereto both perpendicular to the tool side surfaces 17*a*, 17*b* (not shown), 17*c* (not shown) and 17*d* and extending across the center of the tool. In the first preferred embodiment 10, grooves 20, 21 are also known as indents and the flat bottom surface of grooves 20, 21 is defined as the nadir, respectively, thereof. A bore (not shown in FIGS. 1 and 2, but see 122, 122*a* in the second embodiment) vertically through the center of the tool keeps the upper 16 and lower 17 pieces (i.e., the to 16 and bottom 17 members) together. A chamfer (also not shown in FIGS. 1 and 2 but see 123 in the second embodiment) at the bottom of the aperture 122 allows a flathead bolt 24 to be positioned upwardly therethrough and retained therein. The top member 16 is also generally rectangular, preferably 2 5/16× 2 5/16 inches and includes a pair of rectangularly cross section shaped ridges or ribs forming detents 25, 26 extending from the bottom surface (not shown) thereof positioned at 90 degree angles to each other that matingly engage and fill the complementary rectangular grooves 20, 21, in the bottom member 17 of the tool. The bottom flat surface of ridges or ribs forming detents 25, 26 is defined as the apex thereof. The top 16 and bottom 17 members together are preferably 1 inch thick. A wingnut 27 holds the bolt 24 in position and tightens the top against the bottom. The double edged blade 11 has an elongate slot (not shown in FIG. 2 but see 110*a* in the second embodiment) or aperture centrally therealong which the bolt 24 is positioned through to allow the blade 11 to slide completely into the tool body 10 when not in use. Rotating the wing nut 27 on bolt 24 tightens and loosens the top and bottom members against one another and, depending on how tight the wing nut is turned, selectably slidably retains the knife blade in the tool.

FIGS. 3-8 show the insides of the top 160 and bottom 170 pieces or members of a second embodiment 100 of the present invention with the outside surfaces being similar in shape to the first embodiment 10, that is constructed to place the cutting blade 110 at four differing size heights from the bottom of the tool, the 0.375 and 0.450 slots of the first embodiment plus 0.250 and 0.500 slots. Two of the slots 120, 121 are cut at 90 degree angles similarly to the two 20, 21 in the first embodiment, although the diagonal sides of the tool of the second embodiment 171, 172, 173 and 174 are larger than those shown in the first embodiment. Also, the second pair of slots 127, 128 in the top member 160 and the bottom member 170 are shown, again at 90 degrees to each other, but oriented 45 degrees from the first two slots 120, 121.

The second embodiment 100 is built similarly to the first embodiment 10 with the addition of the two additional slots 127, 128. In order to keep the orientation of the four sets of ridges and grooves, at least one post and in this embodiment, two posts 132, 133 are positioned to extend downwardly from the bottom surface of the top member 160 of the tool as locating pins into circular recesses 134, 135 in the top surface of the bottom 170 of the tool. The tool may be made of wood, molded plastic, die or sand cast metal, PTFE (Teflon) or the like.

Figure 7:
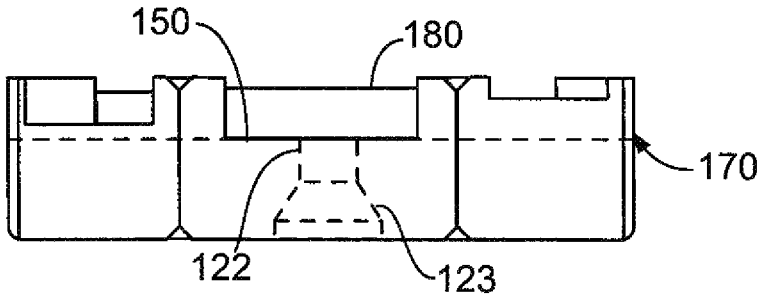
FIG. 7 is a front perspective view of the bottom member of the second embodiment shown in FIG. 6.
Figure 8:
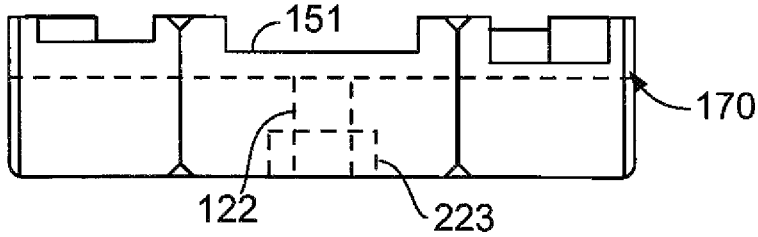
FIG. 8 is an end elevational view of the bottom member of the second embodiment shown in FIG. 6.
Figure 8A:
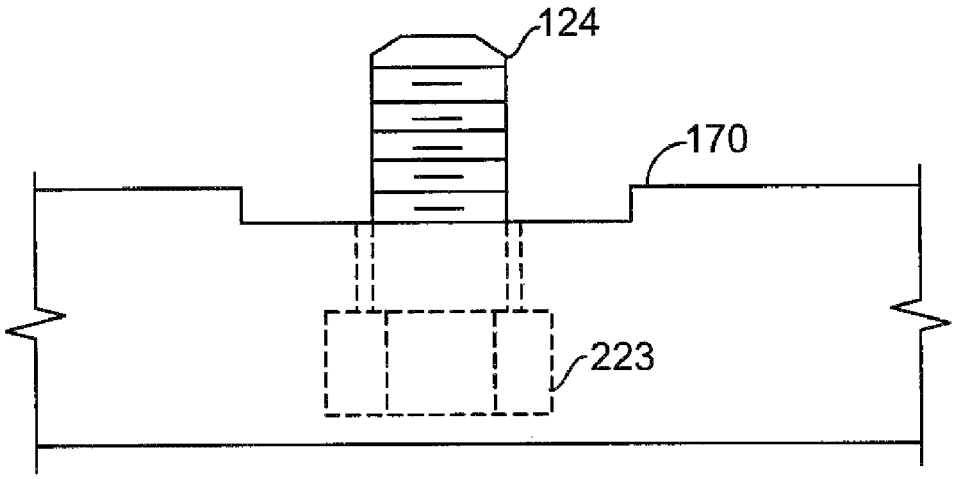
FIG. 8*a* is an enlarged fragmentary detail elevational view of the bottom member of the second embodiment showing a hex head bolt molded into the member.

Additionally, as shown in FIGS. 7 and 8, the chamfer in the bottom of the central hole 122 may be round to accept a flat head bolt, in this case 1/8×1 3/16 inches long, or may also be hexagonal in shape shown at 223 in order to accept a hex head bolt 124 and the hexagonal cut out will maintain that bolt in position to prevent it from rotating in the tool. The hex head bolt may be removable or permanently molded into the tool as shown in FIG. 8A.

Thus, four differing height ceiling relief dimensions are provided in the second embodiment 100 of the tool and the double edged blade 110 may be slidably retained in any of those grooves or indents both wholly within the tool during non-use and slidable positioned party out the side of the tool a set distance and fastened therein by tightening the wing nut on the bolt post, the same as shown in FIGS. 1 and 2, to provide a desired depth of cutting relief. The rectangular ridges 140, 141, 142, 143 on the top member 160 of the tool matingly and complementarily engage the rectangular grooves 150, 151, 152, 153 in the bottom member 170 of the tool so as to provide a secure mounting for the blade 110, in whichever groove the blade is positioned. As shown in all the figures, the nadir or bottom surface of each of the grooves, such as shown at 150, accommodates the knife 110 to allow slidable mounting and fastening of the knife in each respective groove. As shown in FIG. 7, a shim 180, or shims of varying thicknesses may be utilized in the grooves under a blade to modify the heights of the blade in use. The top 160 and bottom 170 members fit together in ridge in groove fashion similarly to the fit of the top 16 and bottom 17 members of the first embodiment shown most clearly in FIGS. 1 and 2. A wing nut and bolt (not shown) identical to wing nut 27 and bolt 24 are utilized to facilitate fastening the members together. As in the first embodiment, tightening the wing nut on the bolt eventually changes the knife mounting from slidable to fixed, as desired by a user.

In Operation

Further to the explanation in the first paragraph of the detailed Description, in use, the second embodiment 100 of the present invention has exactly the same function as the first embodiment 10 with the exception that the diagonally cut chamfer type sides 171, 172, 173, 174 are larger creating an octagon shape tool 100. In any case, the face of the tool out of which the blade 110 is extended is positioned flush against the side of the ceiling tile 12 (FIG. 1) with both being positioned on a flat surface. The tool is drawn across the length or width of the ceiling tile, depending upon which surface of the ceiling tile the relief is to be formed. After a single cut such as 13 is made, the ceiling tile is positioned on its end surface perpendicular to the flat surface on which the tool is residing and a second relief cut such as 15 is made, as appropriate to provide a proper size relief for the ceiling tile 12.

While a new and improved manually operable adjustable ceiling tile relief cutting tool has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A tool for manually cutting relief surfaces adjacent ceiling tile edges, said tool comprising, a body assembly including first and second side surfaces disposed at an angle with respect to one another, said body assembly further including top and bottom members, one of said top and bottom members including a first groove forming an indent in said one member, said first groove having a substantially flat nadir and extending across a surface thereof forming an inner surface of said tool, the other of said top and bottom members including a first rib forming a detent in said other member, said first rib having a substantially flat apex and extending across a surface thereof, said first rib oriented to be complementary to said first groove and forming an inner surface of said tool, a blade slidably fit on said nadir of said first groove on one side thereof, and retained thereon by said apex of said first rib on an opposing side thereof, said blade extending from said first side surface, and fastener means for holding said top and bottom members together and slidably retaining said blade thereon, a first distance from said blade to a working outer surface of said tool being at least one dimension for corresponding to a first relief surface on a ceiling tile, a second groove on said one of said members oriented to cross said first groove at a center of said one said members, and a second rib on said other of said members oriented to be complementary to said second groove on said one of said members, wherein when said blade is disposed in said second groove, said blade is extendable from said second side surface, and wherein a second distance from said blade to said working outer surface of said tool is a second dimension different from said first dimension for corresponding to a second relief surface on said ceiling tile.

2. A tool for manually cutting relief surfaces adjacent edges of an object, said tool comprising, a body assembly including first and second side surfaces disposed at an angle with respect to one another, said body assembly further including top and bottom members, one of said top and bottom members including a first groove in said one member, said first groove having a substantially flat nadir and extending across a surface thereof forming a first inner surface of said tool, the other of said top and bottom members including a first rib in said other member, said first rib having a substantially flat apex and extending across a surface thereof, said first rib oriented to be complementary to said first groove and forming a second inner surface of said tool, a cutting blade slidably fit on said nadir of said first groove on one side thereof, and retained thereon by said apex of said first rib on an opposing side thereof, and fastener means for holding said top and bottom members together and selectably slidably retaining said blade thereon, a first distance from said blade to a working outer surface of said tool being at least one dimension for corresponding to a first relief surface on an object, a second groove on said one of said members oriented to cross said first groove at a center of said one of said members, and a second rib on said other of said members oriented to be complementary to said second groove on said one of said members, wherein when said blade is disposed in said second groove, said blade is extendable from said second side surface, and wherein a second distance from said blade to said working outer surface of said tool is a second dimension different from said first dimension for corresponding to a second relief surface on said object.

3. The tool as defined in claim 2 further including, third and fourth grooves on said one of said members and third and fourth ribs on said other of said members, said third and fourth grooves and ribs being oriented perpendicularly to each other and at about 45 degrees to said first and second grooves and ribs, said third and fourth grooves and ribs defining third and fourth means for retaining said blade thereon at third and fourth dimensions for corresponding to third and fourth relief surfaces on said object.

4. The tool as defined in claim 2 further including, a plurality of additional grooves on said one of said members oriented to cross each other at a center of said one said members, a plurality of additional ribs on said other of said members oriented to be complementary to respective ones of said additional grooves on said one of said members, and each combination of said additional grooves and said additional ribs being a dimension from said working outer surface of said tool differing from each other.

* * * * *